US006526587B1

(12) United States Patent
Jeziak et al.

(10) Patent No.: US 6,526,587 B1
(45) **Date of Patent: *Mar. 4, 2003**

(54) TATTOOED TEAR WEAR

(76) Inventors: Michael C. Jeziak, 29323 Gratiot Ave., Roseville, MI (US) 48066; John A. Motyka, 29323 Gratiot Ave., Roseville, MI (US) 48066

( * ) Notice: Subject to any disclaimer, the term of this patent is extended or adjusted under 35 U.S.C. 154(b) by 0 days.

This patent is subject to a terminal disclaimer.

(21) Appl. No.: 09/978,405

(22) Filed: Oct. 16, 2001

(51) Int. Cl.[7] ..... A41B 1/00
(52) U.S. Cl. ..... 2/69; 2/115; 2/227
(58) Field of Search ..... 2/115, 227, 228, 2/238, 69, 85, 108, 83, 93, 95, 80, 105, 106, 400–408, DIG. 1, 246, 244, 171; 40/586

(56) References Cited

U.S. PATENT DOCUMENTS 308,244 A * 11/1884 Fishel ..... 2/115
3,828,368 A * 8/1974 Lam ..... 2/227
4,813,081 A * 3/1989 Cliff et al. ..... 2/115
5,175,888 A * 1/1993 Clark ..... 2/243.1
5,347,658 A * 9/1994 Clark ..... 2/69
5,515,542 A * 5/1996 Simmons ..... 2/67
5,617,586 A * 4/1997 PeQueen et al. ..... 2/239
5,960,476 A * 10/1999 Danzy ..... 2/115
5,970,516 A * 10/1999 Shimooka ..... 2/69
6,044,492 A * 4/2000 Krogh ..... 2/115
6,067,660 A * 5/2000 Contini ..... 2/246
6,125,472 A * 10/2000 Nakagawa ..... 2/115
6,175,960 B1 * 1/2001 Knittel ..... 2/115

* cited by examiner

*Primary Examiner*—Gloria M. Hale
(74) *Attorney, Agent, or Firm*—Dobrusin & Thennisch P.C.

(57) ABSTRACT

The apparel of the present invention provides a method for creating the allusion of the wearer having a body tattoo. The apparel has an upper layer of material that forms the body of the apparel. An opening is formed within the upper layer to reveal or expose a lower layer of material attached at its periphery to the upper layer. The opening within the upper layer of material is formed by a jagged edge to give the appearance of a tear within the material. The lower layer is a different color than the upper layer of material and is preferably the same color of the wearer's skin tone to give the illusion that the torn area is revealing the wearer's skin. A tattoo is chosen by the wearer and added to the lower layer of material. The tattoo may be a permanent addition to the lower layer or may be removably attached to the lower layer.

13 Claims, 2 Drawing Sheets

TATTOOED TEAR WEAR

TECHNICAL FIELD

The present invention provides a method and an article of apparel creating the illusion of the wearer having a body tattoo.

1. Background of the Invention

Many people enjoy expressing themselves through fashion and body art. In recent years, body art has been used by a wide range of individuals as a means to express their creativity or otherwise create and display an individual lifestyle or fashion statement. These expressions may come in the form of clothing, hair, body piercing and tattoos. Examples of such expressions are torn jeans, dyed hair and tongue piercing, for example. Other expressions are more permanent and may consist of permanent artistic displays to the person's skin. There may come a time when a person may want to change, update or alter these individual expressions only to find out that it is impossible or physically painful to do so. This is particularly true of body piercing and tattoos.

The present invention provides a safe and temporary solution for expressing one's individuality by providing an article of apparel with a torn area for exposing a fake tattoo.

2. Summary of the Invention

The apparel of the present invention provides a method for creating the illusion of the wearer having a body tattoo. More specifically, the apparel has an upper layer of material that forms the body of the apparel (i.e., the apparel may be in any form such as a T-shirt, pants such as jeans or slacks, a jacket, headband, or a vest, for example and the upper layer is the material from which the apparel is formed.) An opening is formed within the upper layer to reveal or expose a lower layer of material attached at its periphery to the upper layer. The opening within the upper layer of material is formed by a jagged edge to give the appearance of a tear within the material. The lower layer is a different color than the upper layer of material and is preferably the same or similar color of the wearer's skin tone to give the illusion that the torn area is revealing the wearer's skin. A tattoo consisting of a selected design or other artistic representation is chosen by the wearer and added to the lower layer of material. The tattoo may be a permanent addition to the lower layer or may be removably attached to the lower layer by an means such as Velcro, adhesive, heat bonding, zip-on, sewn, or the like.

The resulting apparel gives the illusion that the wearer is wearing torn clothing exposing a tattoo on the wearer's skin in the area of the tear. This illusion allows the wearer to choose and interchange a body tattoo and the location of a tear exposing the tattoo without having to expose the wearer's skin or permanently tattooing the wearer's body.

These and other objects of the present invention will become apparent upon reading the following detailed description in combination with the accompanying drawings, which depict systems and components that can be used alone or in combination with each other in accordance with the present invention.

DESCRIPTION OF THE PREFERRED EMBODIMENT

Figure 1:
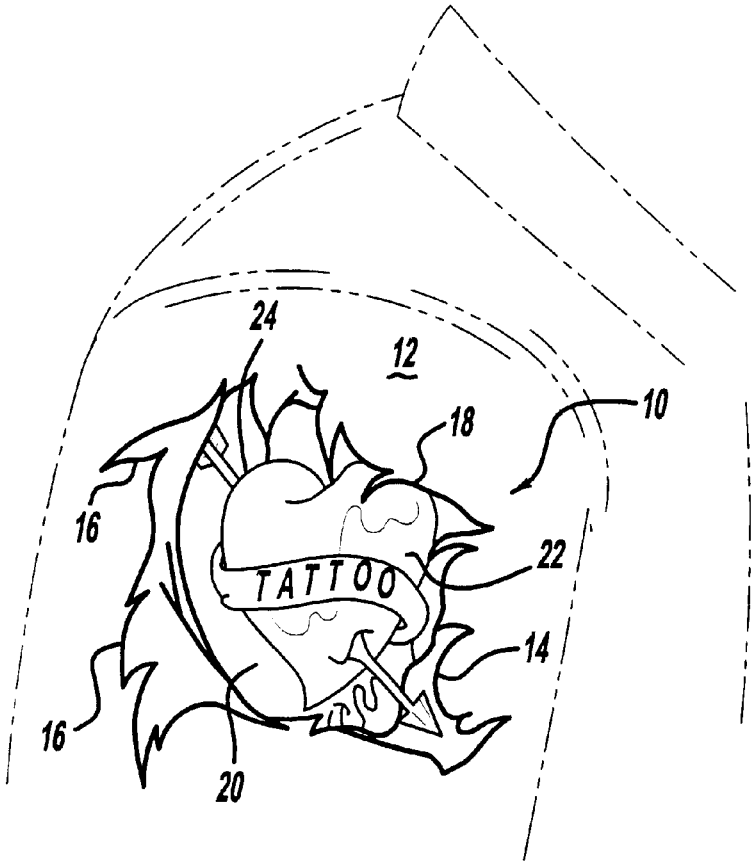
FIG. 1 is a perspective view illustrating a preferred embodiment of the present invention.

With reference to FIG. 1, an article of apparel 10 of the present invention is there shown having an upper layer of material 12 forming the body of the apparel. An opening 14 is created within the upper layer of material 12 and is preferably created with jagged edging 16 around the perimeter 18 to give the appearance of a tear within the body of the apparel 10.

A lower layer of material 20 is exposed through the opening 14. The lower layer 20 may be attached to the perimeter 18 of the upper layer of material 12 by any means such as sewing, for example. The lower layer of material 20 is a different color than the upper layer of material and is preferably the same color as or as closely matching to the wearer's skin tone to give the illusion that the torn area is revealing the wearer's skin. A tattoo 22 is chosen by the wearer and added to the lower layer of material 20. The tattoo 22 may be a permanent addition to the lower layer or may be removably attached along the periphery 24 to the lower layer of material 20 by an means such as Velcro, adhesive, heat bonding, zip-on, sewn, or the like.

Figure 2:
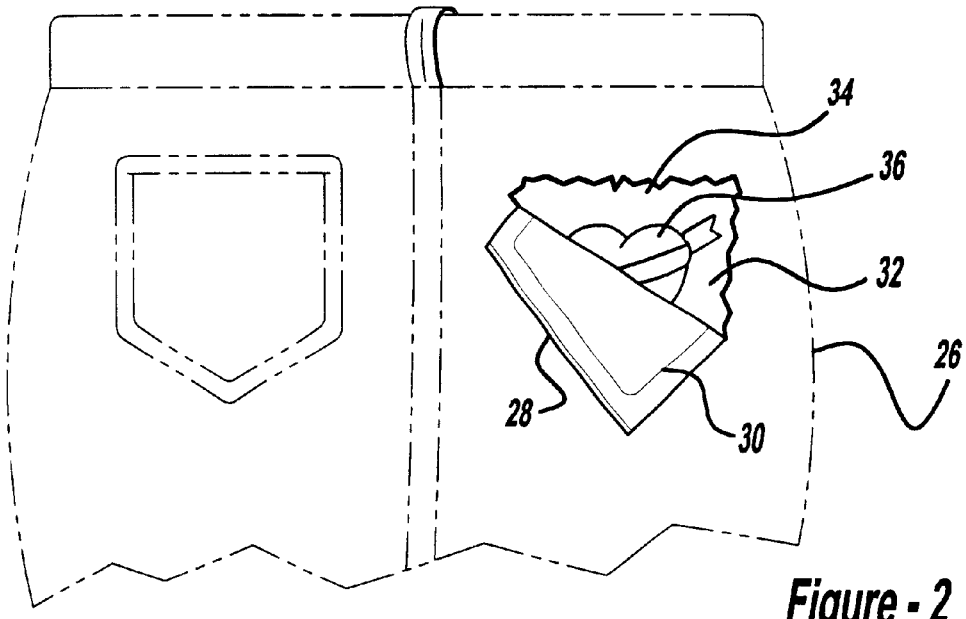
FIG. 2 is a perspective view illustrating a second embodiment of the present invention.

FIG. 2 illustrates a second example of a type of apparel and the location of the torn area. A portion of a pair of pants 26 are there shown with a back pocket 28 having an upper layer of material 30 torn away to expose a lower layer of material 32. Tattered edging 34 is provided along the pocket 28 to give the illusion of a torn area within the pair of pants 26. The lower layer of material 32 is a different color than the upper layer of material and is preferably the same color of the wearer's skin tone to give the illusion that the torn area is revealing the wearer's skin. The choice of color of the lower layer of material 32 is left to the wearer, as is the tattoo design 36. The tattoo 36 may be a permanent addition to the lower layer or may be removably attached along the periphery 38 to the lower layer of material 32 by an means such as Velcro, adhesive, heat bonding, zip-on, sewn, or the like.

Figure 3:
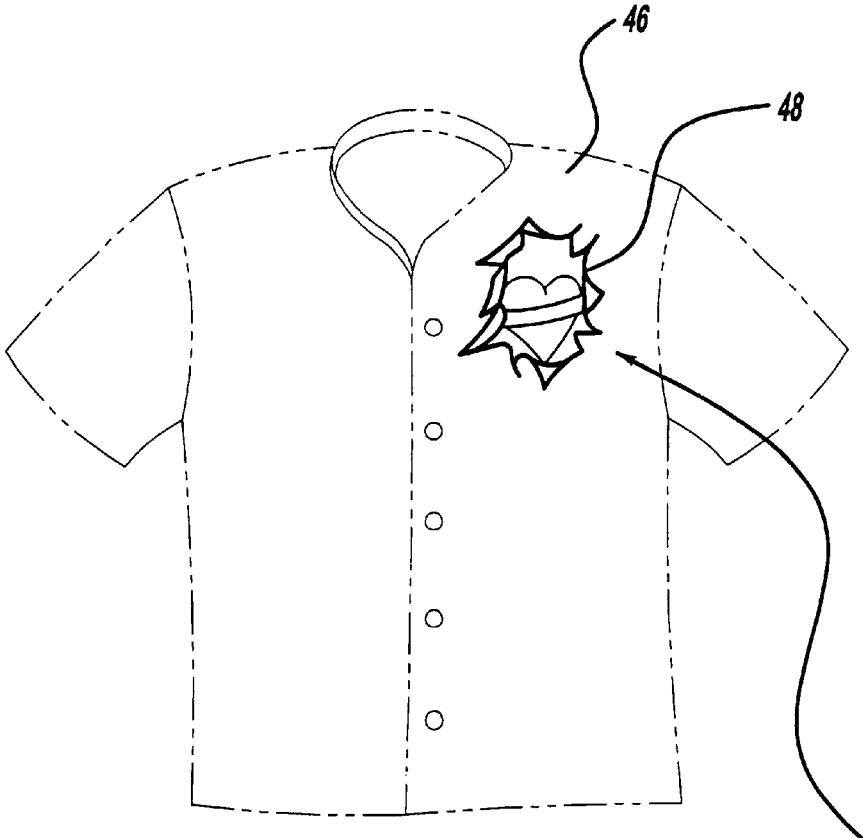
FIGS. 3 and 4 are perspective views illustrating the method for creating the preferred embodiment of the present invention.
Figure 4:
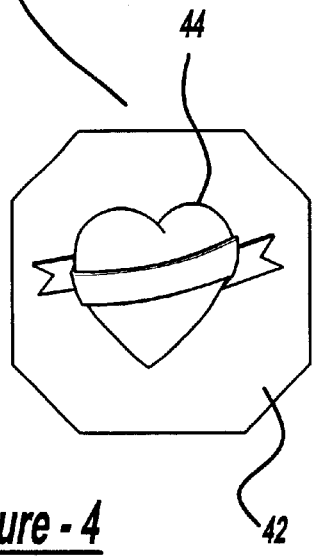

FIGS. 3 and 4 illustrate an article of clothing 40 having the separate layers of material as described above. In particular, the lower layer of material 42 is shown as having a tattoo design 44. The lower layer of material 42 may be removable from the upper layer of material 46 and the tattoo 44 may be removable from the lower layer 42. This allows the wearer to freely choose a tattoo design and the color or design desired for the exposed lower layer of material. The upper layer of material 46 is provided with a tattered edge 48 to give the illusion that the wearer is wearing torn clothing exposing a tattoo on the wearer's skin in the area of the tear. This illusion allows the wearer to choose and interchange a body tattoo and the location of a tear exposing the tattoo without having to expose the wearer's skin or permanently tattooing the wearer's body.

The type of apparel used in the application may be those illustrated or any other form of clothing that may be worn. The upper material may be any type of material preferably used to make clothing. The location of the tear may be anywhere within the body of the apparel and the size of the exposed area is not limited. The tattoo and lower material may also be formed of any type of material and in any color combination preferred by the wearer.

The person of skill in the art will recognize that features and aspects of a method for creating an article of apparel as disclosed herein may be used in any combination described as desired, needed or as may be possible.

It should be understood that the invention is not limited to the exact embodiment or construction that has been illustrated and described but that various changes may be made without departing from the spirit and the scope of the invention.

What is claimed is:

1. A method for creating an article of apparel for creating an illusion of exposing the wearer's skin comprising the steps of:

providing an upper layer of material;

creating an opening within said upper layer of material, said opening having an outer periphery;

exposing a lower layer of material through said opening; wherein said step includes choosing a color for said lower layer of material; and matching the color of said lower layer of material to the wearer's skin color thereby creating the illusion of exposing the wearer's skin through said opening.

2. The method as defined in claim 1, and further comprising the step of:

creating a tattered edge along the periphery of said opening.

3. The method as defined in claim 1, and further comprising the step of:

adding a printed tattoo design to said lower layer of material.

4. The method of claim 3, wherein said tattoo design is contained within said lower layer of material and having a color different than the color of said lower layer of material.

5. The method of claim 3, wherein said printed tattoo design comprises the additional step of:

forming an intermediate layer having a printed tattoo design that is removably attachable to said lower layer.

6. A method for creating an article of apparel for creating an illusion of exposing the wearer's skin comprising the steps of:

providing an upper layer of material;

creating an opening within said upper layer of material;

exposing a lower layer of material through said opening;

matching the color of said lower layer of material to the wearer's skin; and adding a printed tattoo design to said lower layer of material.

7. The method as defined in claim 6, and further comprising the step of:

matching the color of said lower layer of material to the wearer's skin color thereby creating the illusion of exposing the wearer's skin through said opening.

8. The method as defined in claim 6, and further comprising the step of:

creating a tattered edge along the periphery of said opening.

9. The method of claim 6, wherein said tattoo design is contained within said lower layer of material.

10. The method of claim 6, wherein said tattoo design is contained within said lower layer of material and having a color different than the color of said lower layer of material.

11. A method for creating an article of apparel comprising the steps of:

providing an upper layer of material;

creating an opening within said upper layer of material;

exposing a lower layer of material through said opening; and forming an intermediate layer having a printed tattoo design that is removably attachable to said lower layer.

12. The method as defined in claim 11, and further comprising the step of:

matching the color of said lower layer of material to the wearer's skin color thereby creating the illusion of exposing the wearer's skin through said opening.

13. The method as defined in claim 11, and further comprising the step of:

creating a tattered edge along the periphery of said opening.

* * * * *